US010494741B2

(12) United States Patent
Deguchi et al.

(10) Patent No.: US 10,494,741 B2
(45) Date of Patent: Dec. 3, 2019

(54) ABSORBENT FABIC

(71) Applicant: ASAHI KASEI KABUSHIKI KAISHA, Tokyo (JP)

(72) Inventors: Junko Deguchi, Tokyo (JP); Hiroyuki Kinouchi, Tokyo (JP); Misako Yamamuro, Tokyo (JP)

(73) Assignee: ASAHI KASEI FIBERS CORPORATION, Osaka (JP)

( * ) Notice: Subject to any disclaimer, the term of this patent is extended or adjusted under 35 U.S.C. 154(b) by 241 days.

(21) Appl. No.: 15/038,915

(22) PCT Filed: Nov. 25, 2014

(86) PCT No.: PCT/JP2014/081100

§ 371 (c)(1),
(2) Date: May 24, 2016

(87) PCT Pub. No.: WO2015/076412

PCT Pub. Date: May 28, 2015

(65) Prior Publication Data

US 2016/0376730 A1 Dec. 29, 2016

(30) Foreign Application Priority Data

Nov. 25, 2013 (JP) ..... 2013-243248
Jun. 4, 2014 (JP) ..... 2014-116251

(51) Int. Cl.
*D01F 6/92* (2006.01)
*D06M 101/32* (2006.01)
(Continued)

(52) U.S. Cl.
CPC ..... *D01F 6/92* (2013.01); *D01F 6/84* (2013.01); *D01F 11/08* (2013.01); *D06M 11/38* (2013.01);
(Continued)

(58) Field of Classification Search
CPC ..... D01F 6/92; D01F 11/08
See application file for complete search history.

(56) References Cited

U.S. PATENT DOCUMENTS 6,387,970 B1 * 5/2002 Nishida ..... B01D 53/261 521/143
2006/0055755 A1 * 3/2006 Yui ..... B41J 11/0015 347/101
2012/0207955 A1 * 8/2012 Ogata ..... D01D 5/253 428/35.5

FOREIGN PATENT DOCUMENTS

JP 58-183719 9/1983
JP 60-155770 8/1985
(Continued)

OTHER PUBLICATIONS

JP-2014101599-A—Translation and Bib data; Deguchi Junko; Jun. 2014 (Year: 2014).*
(Continued)

*Primary Examiner* — Humera N Sheikh
*Assistant Examiner* — Elizabeth D Ivey
(74) *Attorney, Agent, or Firm* — Finnegan, Henderson, Farabow, Garrett & Dunner LLP

(57) ABSTRACT

Provided is a fabric that semi-permanently absorbs water even without being subjected to water absorption treatment, i.e., an absorbent fabric that has a pleasant feel, can quickly absorb perspiration when worn, has excellent comfort, and is soft and suitable for use in inner wear, sportswear, etc. The absorbent fabric according to the present invention includes polyester fibers in which ethylene terephthalate constitutes at least 95 mol % of repeating units, wherein a carboxylic acid terminated linear oligomer component is present on the surface of the polyester fibers, and the absorbency according to the JIS L1907 dripping method after washing 30 times according to the JIS L0217 103 C method is at most 5 seconds. The polyester fibers preferably contain 0.005-1 wt % of the S element.

6 Claims, 8 Drawing Sheets

(51) Int. Cl.
*D01F 6/84* (2006.01)
*D06M 11/38* (2006.01)
*D01F 11/08* (2006.01)

(52) U.S. Cl.
CPC ... *D06M 2101/32* (2013.01); *D10B 2401/022* (2013.01); *D10B 2501/00* (2013.01); *D10B 2503/06* (2013.01)

(56) References Cited

FOREIGN PATENT DOCUMENTS

| | | | | |
|---|---|---|---|---|
| JP | 9-158049 | | | 6/1997 |
| JP | 9-188964 | | | 7/1997 |
| JP | H10-317276 | A | | 12/1998 |
| JP | H11-12925 | A | | 1/1999 |
| JP | 2002-115175 | A | | 4/2002 |
| JP | 2002-309485 | | | 10/2002 |
| JP | 2002-363864 | | | 12/2002 |
| JP | 2003119665 | A | * | 4/2003 |
| JP | 2003-227073 | | | 8/2003 |
| JP | 2005-089891 | A | | 4/2005 |
| JP | 2005-200799 | | | 7/2005 |
| JP | 2005-264378 | A | | 9/2005 |
| JP | 2010-255130 | | | 11/2010 |
| JP | 2014-101598 | | | 6/2014 |
| JP | 2014-101599 | | | 6/2014 |
| JP | 2014101599 | A | * | 6/2014 |
| JP | 6095798 | | | 3/2017 |

OTHER PUBLICATIONS

JP-2003119665-A; Translation and Bib data; Maesaki, Masahiko; Apr. 2003 (Year: 2003).*

Korean Office Action issued in corresponding Korean Patent Application No. 10-2016-7008812, dated Mar. 16, 2017.

Japanese Patent Office PCT/ISR, dated Feb. 24, 2015.

Written Opinion of the International Searching Authority of translated International PCT of Japanese Patent Application 2014-081100, dated Feb. 24, 2015.

Taiwanese Office Action in prosecution of Taiwanese Patent Application No. 103140394, dated Mar. 4, 2015.

Yokohama City Pollution Research Institute, No. 8 (1983).

Dyeing Processes Lecture 4—Scouring/Bleaching and Dip Dyeing, (Jun. 25, 1968).

Academic Year 2013, Strategic Foundational Technology Improvement Support Operation "Development of Discrete Dyeing Integrated Processing Technology to Realize High-Performance, High-Sensitivity Ultrafine Fiber Products with Energy Savings", Research and Development Summary Report, (Mar. 2014).

* cited by examiner

| Peak | Detected ion (m/z) | Estimated molecular weight | Presumed structure |
|---|---|---|---|
| a | 429.12 $[M+H]^+$ | 428.11 |  |
| b | 594.16 $[M+NH_4]^+$ | 576.13 |  |
| x | 785.17 $[M-H]^-$ | 786.18 |  |
| y | 977.21 $[M-H]^-$ | 978.22 |  |

2[c].C9

| | Assignments of detected positive ion peaks |
|---|---|
| ● |  |
| ■ |  |
| ▲ |  |
| ◆ |  |

ABSORBENT FABRIC

TECHNICAL FIELD

The present invention relates to a fabric having absorbency. More particularly, the present invention relates to an absorbent fabric that absorbs water semi-permanently even without being subjected to water absorption treatment, is able to quickly absorb perspiration as a result of having superior water absorbency, and can be preferably used in applications such as inner wear, sportswear or bedding due to its softness and pleasant feel.

BACKGROUND ART

Synthetic fibers such as polyester or polyamide fibers are used as general-purpose materials in applications such as inner wear or sportswear. However, since these synthetic fibers are hydrophobic fibers, water absorption treatment is required when used in products worn close to the skin in particular, while also having the problem of undergoing a decrease in water absorbency following repeated laundering. The loss of water absorption treatment agent is particularly remarkable when laundering at high temperatures in the manner of so-called industrial laundering used to wash uniforms and the like, thereby resulting in the need for improved washing durability.

Various studies have been conducted on methods for improving water absorbency of polyester.

For example, in Patent Document 1 indicated below, water absorbency is imparted by treating polyester fibers with a wafer absorbing agent followed by covering the water absorbing agent with a hydrogel. In this method, since the water absorbing agent is isparted by processing, deterioration, of water absorbency cannot be avoided even it covered with a hydrogel, performance ends up decreasing following repeated laundering, and there is the potential for performance to decrease even further when subjected to high-temperature laundering in the manner of industrial laundering. Moreover, there is also the risk of impairment of fiber softness as a result of covering the fibers with a hydrogel.

In addition, although Patent Document 2 indicated below describes that a polyester fiber woven fabric is produced by subjecting polyester fibers to alkaline processing followed by treating with a treatment liquid containing a hydrophilic agent, since performance decreases due to repeated laundering in the case of subjecting ordinary polyester fibers to alkaline processing and hydrophilic processing, water absorbency having washing durability cannot be imparted.

PRIOR ART DOCUMENTS

Patent Documents

Patent Document 1: Japanese Unexamined Patent Publication No. H9-158049

Patent Document 2: Japanese Unexamined Patent Publication No. 2005-200799

DISCLOSURE OF THE INVENTION

Problems to be Solved by the Invention

An object of the present invention is to provide a fabric that semi-permanently absorbs water even in the case of not undergoing water absorption treatment, or in other words, an absorbent fabric that is able to quickly absorb perspiration when worn, has superior comfort, is soft, has a pleasant feel, and can be preferably used in applications such as inner wear or sportswear, and to provide a fabric that retains durable water absorbency even after industrial laundering for which there is susceptibility to a decrease in water absorbency attributable to laundering.

Means for Solving the Problems

As a result of conducting extensive research ana repeated experiments to solve the aforementioned problems, the inventors of the present invention found that the aforementioned problems can be solved by incorporating a specific oligomer in a specific polyester yarn, thereby leading to completion of the present invention.

Namely, the present invention is as indicated below.

[1] An absorbent fabric in which polyester fibers constitute 95 mol % or more of the repeating units of ethylene terephthalate, wherein a carboxylic acid terminated linear oligomer component is present on the surface of the polyester fibers, and water absorbency according to the dripping method of JIS L1907 after washing 30 times according to Method C of JIS L0217 No. 103 is 5 seconds or less.

[2] The absorbent fabric described in [1] above, wherein water absorbency according to the dripping method of JIS L1907 after washing once according to Method C of JIS L0217 No. 103 is 5 seconds or less.

[3] The absorbent fabric described in [1] or [2] above, wherein the polyester fibers contain 0.005% by weight to 1% by weight of the S element.

[4] The absorbent fabric described in [3] above, wherein the polyester fibers containing 0.005% by weight to 1% by weight of the S element are polyester fibers containing 0.5 mol % to 5 mol % of an ester-forming sulfonate compound.

[5] The absorbent fabric described in [4] above, wherein the ester-forming sulfonate compound is a metal sulfonate group-containing isophthaiic acid.

[6] The absorbent fabric described in any of [1] to [5] above, wherein 0.1 to 30 pits having a length of 0.5 μm to 5 μm are formed in an area of 100 $\mu m^2$ on the surface of the polyester fibers containing 0.005% by weight to 1% by weight of the S element.

[7] The absorbent fabric described in any of [1] to [6] above, wherein the peak intensity ratio of the n=8 carboxylic acid terminated linear oligomer component to an internal standard is 0.05 to 0.100.

[8] The absorbent fabric described in any of [1] to [7] above, wherein the concentration of the n=4 carboxylic acid terminated linear oligomer component is equivalent to a concentration of 2 μg/ml to 15 μg/ml by internal standardization.

[9] The absorbent fabric described in any of [1] to [8] above, wherein, the concentration of the n=3 cyclic oligomer is equivalent to a concentration of 80 μg/ml or less by internal standardization.

[10] A method for producing the absorbent fabric described in any of [1] to [9] above, comprising: a step for performing alkaline reduction on polyester fibers at a reduction rate of 0.6% to 9% in a fabric containing polyester fibers containing the S element at 0.005% by weight to 1% by weight.

Effects of the Invention

The absorbent fabric of the present invention can be preferably used in applications such as inner wear or sportswear since it absorbs water semi-permanently even in the case of not being subjected to water absorption treatment, is able to quickly absorb perspiration when worn, has superior comfort, is soft and has a pleasant feel.

BEST MODE FOR CARRYING OUT THE INVENTION

The following provides a detailed explanation of embodiments of the present invention.

The polyester fibers that compose the fabric of the present embodiment are characterized by having a carboxylic acid terminated linear oligomer component on the surface thereof. Water absorbency demonstrates durability against repeated laundering as a result of having a carboxylic acid terminated linear oligomer component on the surface. Here, the carboxylic acid terminated linear oligomer component can be that in which n=3 to 10 represented by the following formula (1).

[Formula 1]

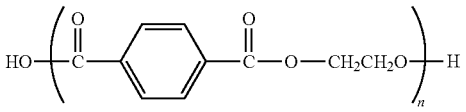

A fabric containing polyester fibers having a carboxylic acid terminated, linear oligomer component in this manner has superior water absorption performance.

The presence of the oligomer component can be confirmed qualitatively and quantitatively by combining the two types of analytical techniques indicated below.

Those carboxylic acid terminated linear oligomer components that have a comparatively low molecular weight can be analyzed by LC/MS (liquid chromatography-mass spectroscopy) after dissolving in THF. If a typical component thereof is assumed to be that in which n=4, n=4 oligomer components present on the fiber surface can be measured using the method indicated below.

A 100 g sample in the form of polyester yarn extracted from the fabric is placed in a glass sample bottle having a volume of 20 mL (AS ONE Laboran Pack screw bottle 9-852-07 No. 5) followed by the addition of 3 ml of THF. After stirring for 6 hours at about 800 rpm/min using the Model M-41 Yamato Mag-Mixer, the solution is allowed to stand undisturbed for 4 days followed by performing LC/MS on the THF solution to analyze components extracted from the sample. A 0.495 ml solution is sampled while ensuring that solids do not enter when sampling the THF solution, and a 0.005 ml solution of a 1 mg/ml methyl benzoate solution is added to prepare the sample. The conditions for LC/MS analysis are as indicated in Table 1 below.

TABLE 1

| | | | | |
|---|---|---|---|---|
| LC | Apparatus | Waters, UPLC | | |
| | Column | Imtakt, Candenza CD-C18 (2 mm I.D., 30 nm) | | |
| | Column temperature | 40° C. | | |
| | Detection | PDA 210-400 nm | | |
| | Flow rate | 0.2 mL/min | | |
| | Mobile phase | A = water<br>B = acetonitrile/THF (20/80) | | |
| | | Time (min) | A % | B % |
| | Gradient | 0 | 90 | 10 |
| | | 10 | 0 | 100 |
| | | 10.1 | 90 | 10 |
| | | 20 | 90 | 10 |
| | Injection volume | 2 μL | | |
| MS | Apparatus | Waters, Synapt G2 | | |
| | Ionization | ESI+, ESI− | | |
| | Scanning range | m/z 50-2000 | | |

Figure 1:
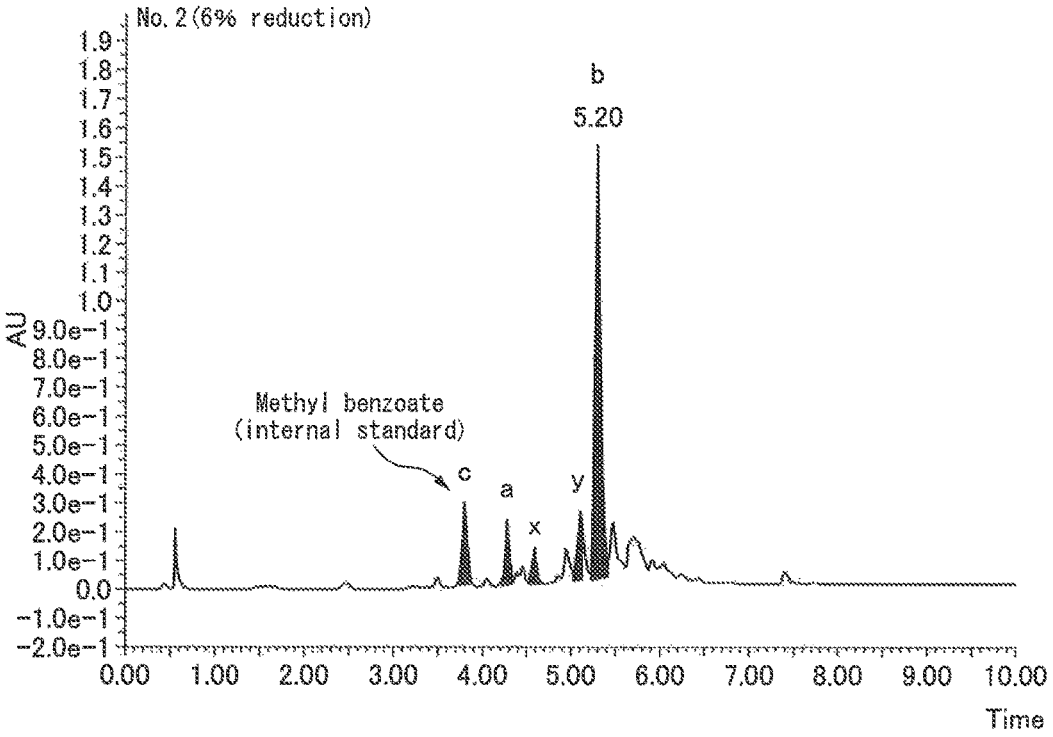
FIG. 1 is a UV chromatogram obtained during LC/MS measurement (240 nm).

FIG. 1 shows an example of the chart of a UV chromatogram of the THF solution (240 nm). In FIG. 1, a large number of the aforementioned carboxylic acid terminated linear oligomer component and cyclic oligomer component peaks to be subsequently described were detected. Peak x in FIG. 1 is derived from the n=4 carboxylic acid terminated linear oligomer component (molecular weight: 786.24). This is deduced based on the detection of an ion ($[M-H]^-$) having a mass number (m/z) of 785 in the ESI-mass spectrum of this peak (electrospray ionization, negative ion mass spectrum). The structures of other peaks can also be similarly deduced from the mass numbers of ions detected by ESI-mass spectroscopy.

In the case a peak derived from the aforementioned oligomer cannot be identified in the UV chromatogram, a mass chromatogram is displayed for a mass number of 785 (vertical axis: detection intensity of specific mass number, horizontal axis: retention time), and whether or not the oligomer is present can be determined based on whether or not a detection intensity peak (peak z) having that mass number is present in the vicinity of the retention time estimated from the example of the UV spectrum (approx. 4.5 min in FIG. 1).

The amount of an n=4 carboxylic acid terminated linear oligomer can be measured using the peak area on a UV chromatogram, and can be converted to a concentration from the ratio with the peak area of the peak of methyl benzoate (peak s) added as an internal standard on the UV chromatogram. The location of peak s of the internal standard is estimated by detecting the corresponding mass number in the ESI-mass spectrum of that peak. In the case peak x is not well-defined on the UV chromatogram for reasons such as overlapping with another peak, by using the area of peak z on a mass chromatogram for a mass number of 785 as previously described and then determining the intensity ratio between x and z by measuring a different sample in which both peaks x and z are well defined; the area of peak z of the sample of interest can be converted to the area of peak x. The strength ratio with peak s can then be calculated using the area of peak x of the sample in question.

The amount of an n=4 carboxylic acid terminated linear oligomer in the fabric of the present embodiment is preferably equivalent to 2 μg/ml to 15 μg/ml, and more preferably equivalent to 3 μg/ml to 10 μg/ml, as the concentration of the internal standard.

Although this type of carboxylic acid terminated linear oligomer contributes to water absorbency, a cyclic oligomer, such as that represented by the following formula (2):

[Formula 2]

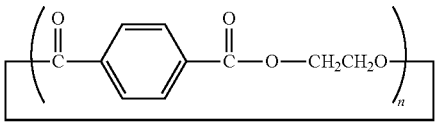

does not have water absorbency, and conversely impairs water absorbency. The amount of the cyclic oligomer represented by formula (2) can also be analyzed by LC/MS (liquid chromatography/mass spectroscopy) after dissolving in THF, and the concentration by internal standardization can be determined from the ratio of peak intensity to the internal standard. If a typical component thereof is assumed to be that in which n=3, then the amount of the n=3 cyclic oligomer is preferably equivalent to 80 μg/ml or less, and more preferably equivalent to 70 μg/ml or less, as the concentration by internal standardization.

More specifically, in the example of the chart of the UV chromatogram (240 nm) of FIG. 1, peak b is the peak of the n=3 cyclic oligomer component. This peak can be confirmed to be derived from the cyclic oligomer component (molecular weight: 576.18) based on the detection of an ion ($[M-NH4]^+$) having a mass number (m/z) of 594 in the ESI-mass spectrum of this peak (electrospray ionization, positive ion mass spectrum). In the case the peak derived from the aforementioned oligomer is not well-defined, a mass chromatogram is displayed for a mass number of 594, and whether or not the oligomer is present can be determined based on whether or not a detection intensity peak (peak w) having that mass number is present in the vicinity of the retention time estimated from the example of the UV spectrum (approx. 5.3 min in FIG. 1).

The amount of this oligomer present can be measured using the peak area on a UV chromatogram, and can be converted to a concentration from the ratio with the peak area of the peak of methyl benzoate (peak s) added as an internal standard on the UV chromatogram.

Since those carboxylic acid terminated linear oligomers that have a comparatively high molecular weight do not dissolve easily in THF, they cannot be detected by the aforementioned method. The fabric according to the present embodiment preferably retains a carboxylic acid terminated linear oligomer which has a comparatively high molecular weight and is not extracted with THF, on the surface of the polyester fibers that compose the fabric, even after the oligomer that is soluble in the aforementioned THF has been extracted. This carboxylic acid terminated linear oligomer strongly adheres to the fibers, and since this oligomer is resistant to elation even after repeated laundering, it is thought to demonstrate an even greater effect on water absorbency after repeated laundering.

The oligomer having a comparatively high molecular weight that is not extracted by THF treatment can be quantified by MALDI-TOF/MS measurement.

A sample obtained after extracting an oligomer with THF is air-dried followed by sampling 2 mg, placing in a glass sample bottle having a volume of 20 mL and adding 1 ml of hexafluoroisopropanol (HFIP) to dissolve the sample. In addition, the matrix solution indicated below is prepared. The 20 μL sample solution is sampled followed by the addition of 20 μL of the matrix solution. After stirring and mixing in a glass capillary tube into which the sample has been collected, a precipitated component is immediately confirmed. The lower layer solution, and not the precipitate in the upper layer, is collected and subjected to MALDI-TOF/MS measurement under the conditions indicated below. During measurement, the measurement is performed at a laser intensity at which the matrix intensity is 50 mV/profiles to less than 2000 mV/profiles.

[Measurement Conditions]

Apparatus: Shimadzu AXIMA CFR Plus

Laser: Nitrogen laser (337 nm)

Detector type: Linear mode

Ion detection: Positive ions (positive mode)

Negative ions (negative mode)

Cumulative number: 500 times

Matrix solution: CHCA (α-cyano-4-hydroxycinnamic acid) 10 mg/ml $H_2O+CH_3CN$

Cationization agent: NaI, 1 mg/ml acetone

Scanning range: m/z 1-8000

Figure 3:
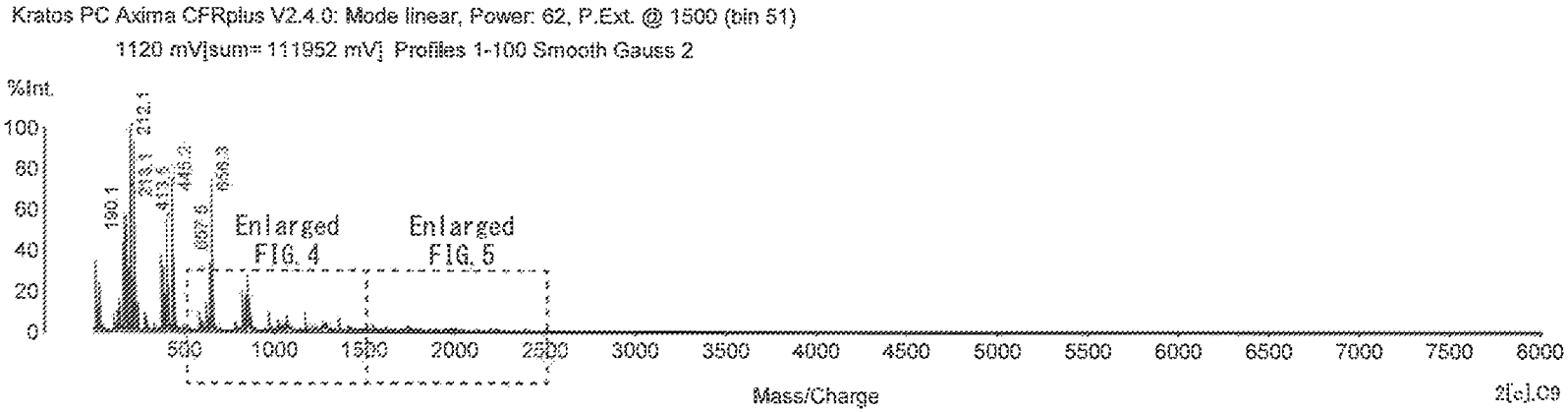
FIG. 3 is a graph of a MALDI-TOF/MS spectrum (positive ion mode) (entire range).
Figure 4:
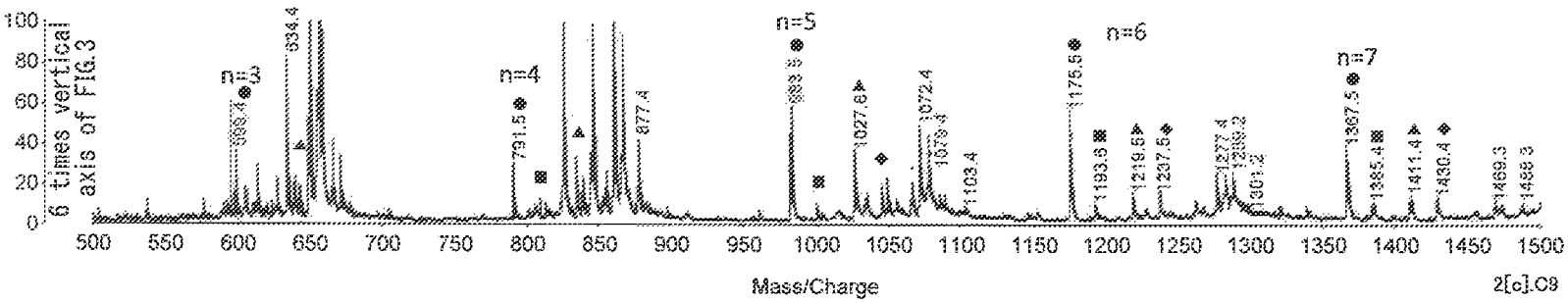
FIG. 4 is a graph of a MALDI-TOF/MS spectrum (positron ion mode) (m/z 500-1500).
Figure 5:
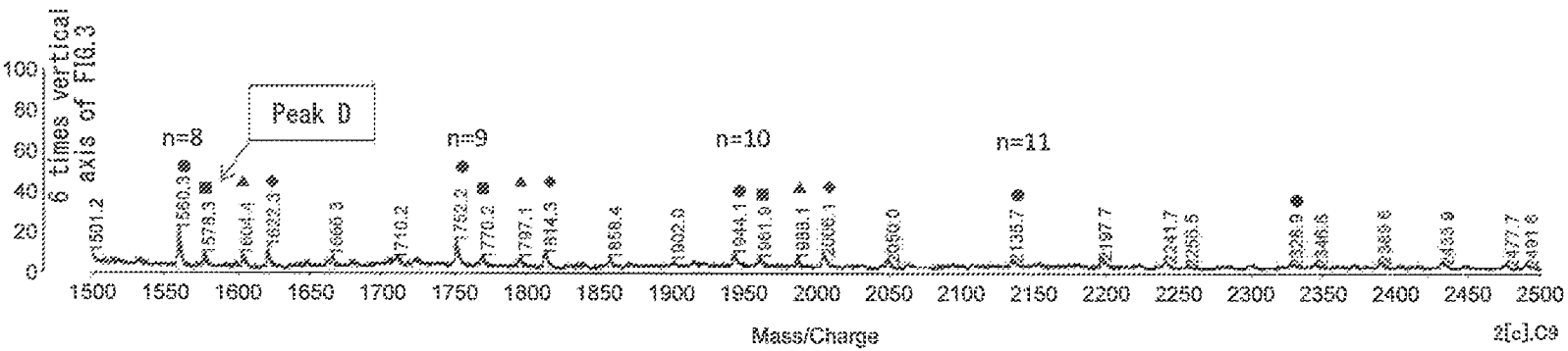
FIG. 5 is a graph of a MALDI-TOF/MS spectrum (positive ion mode) (m/z 1500-2500).
Figure 6:
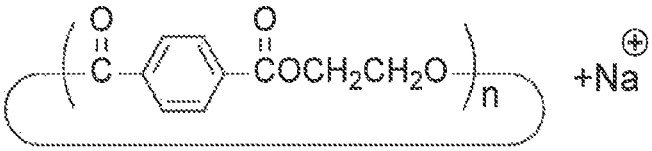
FIG. 6 is a drawing for explaining the assignment of detected positive ion peaks.
Figure 6:
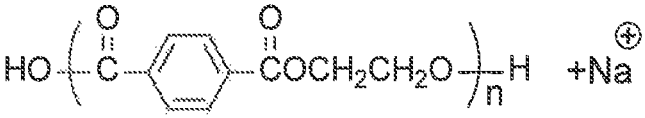
Figure 6:
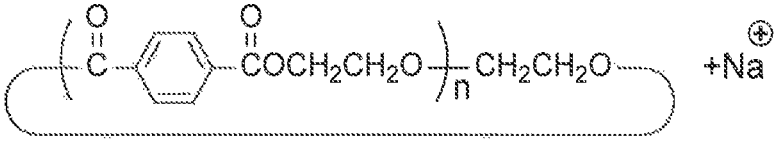
Figure 6:
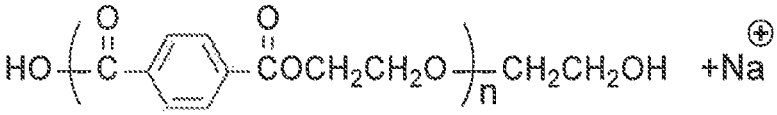

FIGS. 3 to 5 indicate examples of positive ion spectra obtained during MALDI-TQF/MS measurement. In FIGS. 3 to 5, peaks were detected that were derived from carboxylic acid terminated linear oligomers in the vicinity of n=4 to 10 and oligomers similar thereto, and peaks indicated with black squares (■) indicate peaks corresponding to the carboxylic acid terminated linear oligomers deduced from the mass number detected by MS spectroscopy.

In the present embodiment, the presence of an n=4 to 10 carboxylic acid terminated linear oligomer component of Formula (1) is extremely effective for durability of water absorbency. The n=4 to 10 carboxylic acid terminated linear oligomer component is quantified according to the method indicated below.

The peak of an n=4 to 10 carboxylic acid terminated linear oligomer is detected in the form of an Na adduct in a positive ion spectrum of MALDI-TOF/MS. The amount of the oligomer component can be evaluated in terms of the value obtained by standardizing the peak intensity of the oligomer Na adduct with the matrix (CHCA) peak intensity. Namely, the value obtained by dividing the peak height of the oligomer Na adduct by the peak height (m/z=212) of the Na adduct of the matrix (CHCA) is taken to be an indicator of the amount of the component, and the peak heights of each of the oligomer Na adducts for n=4 to n=10 are divided by the peak height of the Na adduct of CHCA followed by evaluating based on the sum total thereof. This value is preferably 0.07 or more and more preferably 0.10 or more. There is excessive progression of decomposition if the value of the sum total exceeds 0.5, thereby making this undesirable.

In particular, the contribution of an n=8 to 10 carboxylic acid terminated linear oligomer component to water absorbency durability is extremely large. If a typical example thereof is as suited to be that in which n=8, then the ratio of peak intensity of the n=8 carboxylic acid terminated linear oligomer component to that of the internal standard can be determined with the value obtained by dividing the peak height of an Na adduct of an n=8 oligomer (peak D in FIG.

5) by the peak height of an Na adduct of CHCA, and this value is preferably 0.005 to 0.1 and more preferably 0.008 to 0.08.

The fabric of the present embodiment demonstrates a water absorption effect by having n=3 to 10 carboxylic acid terminated linear oligomers present that are soluble and insoluble in THF. There are no particular limitations on the method used to have the oligomers present, and although they may be imparted by a method consisting of, for example, coating a carboxylic acid terminated linear oligomer component on a fabric or mixing into an ester polymer, they can be imparted in the vicinity of the fiber surface in a specific polyester fiber by a specific alkaline treatment, thereby making this preferable.

For example, the carboxylic acid terminated linear oligomer can be imparted by subjecting polyester fibers containing 0.005% by weight to 1% by weight of the S element to a specific alkaline treatment. Examples of polyester fibers containing 0.005% by weight to 1% by weight of the S element include polyester fibers containing 0.5 mol % to 5 mol % of an ester-forming sulfonate compound.

Examples of ester-forming sulfonate compounds contained at 0.5 mol % to 5 mol % in polyester fibers include sodium 5-sulfoisophthalate, potassium 5-sulfoisophthalate, sodium 4-sulfo-2,6-naphthalenedicarboxylate, sodium 2-sulfo-4-hydroxybenzoate, 3,5-dicarboxylic acid benzenesulfonic acid tetraraethylphosphonium salt, 3,5-dicarboxylic acid benxenesulfonic acid tetrabutylphosphonium salt-3,5-dicarboxylic acid benzenesulfonic acid tributylmethylphosphonium salt, 2,6-dicarboxylic acid naphthalene-4-sulfonic acid tetrabutylphosphonium salt, 2,6-dicarboxylic acid naphthalene-4-sulfonic acid tetramethylphosphonium salt, 3,5-dicarboxylic acid benzenesulfonic acid ammonium salt, and methyl, dimethyl or other ester derivatives thereof. These methyl, dimethyl or other ester derivatives are used preferably from the viewpoint of imparting superior polymer whiteness and rate of polymerization. The polyester fibers preferably contain a metal sulfonate group-containing isophthalic acid component such as sodium 5-sulfoisophthalate or potassium 5-sulfoisophthalate, and particularly preferably contain sodium 5-sulfoisophthalate.

The reason why an ester-forming sulfonate compound is particularly preferable is that, in contrast to hardly any formation of oligomer since the terminal group is hydrolyzed by alkaline treatment in the case of ordinary polyester fibers, in the case of polyester fibers containing an ester-forming sulfonate compound, an alkali preferentially attacks the position of the S element as a result of alkaline treatment, and since this results in the occurrence of cleavage of the molecular chain at intermediate locations, the amount of oligomer having a carboxyl group on the terminal group thereof is presumed to increase.

The polyester fibers according to the present embodiment can be polyester fibers containing a non-ester-forming sulfonate compound. Polyester fibers containing a non-ester-forming sulfonate compound refers to polyester fibers containing a sulfonate compound that does not form polyester by polycondensation as a result of a sulfonate compound undergoing direct esterification with polyester, and examples thereof include polyester fibers obtained by a method consisting of mixing master chips incorporating 0.5 mol % to 5 mol % of a sulfonate compound and polyester chips containing 95 mol % or more of an ordinary ethylene terephthalate component, and polyester fibers obtained by directly adding 0.5 mol % to 5 mol % of a sulfonate compound during polymerization.

Examples of non-ester-forming sulfonate compounds include alkaline metal salts of alkyl sulfonates and alkaline metal salts of alkyl benzene sulfonates. Examples of alkaline metal salts of alkyl sulfonic acid include sodium dodecyl sulfonate, sodium undecyl sulfonate and sodium tetradecyl sulfonate. In addition, examples of alkaline metal salts of alkyl benzene sulfonates include sodium dodecyl benzene sulfonate, sodium undecyl benzene sulfonate and sodium tetradecyl benzene sulfonate. Sodium dodecyl benzene sulfonate is particularly preferable from the viewpoint of processing stability.

A water absorption effect is obtained by subjecting polyester fibers containing 0.005% by weight to 1% by weight of the S element to a specific alkaline treatment, and the resulting fabric undergoes hardly any change in that effect even after repeated laundering. If the content of the S element is less than 0.005% by weight, the effect of imparting durability to water absorbency following alkaline treatment is small, while in the case the polyester fibers contain 1% by weight or more of the S element, fiber strength decreases making spinning difficult. The content of the S element in the polyester fibers is more preferably 0.01% by weight to 0.8% by weight and even more preferably 0.015% by weight to 0.7% by weight. Furthermore, inductively coupled plasma atomic emission spectroscopy (ICP-AES) is used as a method for quantifying the S element.

In the case of containing an ester-forming sulfonate compound, if the content thereof is less than 0.5 mol %, the effect of imparting durability to water absorbency following alkaline treatment is small, while in the case the polyester fibers contain greater than 5 mol % of the ester-forming sulfonate compound, fiber strength decreases making spinning difficult. The content of the ester-forming sulfonate compound in the polyester fibers is more preferably 1 mol % to 4.5 mol % and even more preferably 1.5 mol % to 4 mol %. Furthermore, whether the S element contained in the polyester is derived from an ester-forming sulfonate compound or derived from a non-ester-forming sulfonate compound can be determined by, for example, decoxaposing the polyester into monomers by alkaline hydrolysis, analyzing the monomers by LC/MS and the like, and determining whether or not an ester-forming sulfonate compound is detected. Analysis may also be performed by derivatization of the compounds as necessary.

In order to demonstrate water absorbency, the conditions for alkaline treatment are such that the fiber reduction rate is preferably 0.6% to 9%, more preferably 1% to 8%, and even more preferably 1.5% to 7%. Reduction rate can be calculated from the weight of the polyester yarn before and after alkaline treatment. In the case of polyester fibers containing 0.5 mol % to 5 mol % of an ester-forming sulfonate compound, the fibers are preferably treated after adjusting to a low alkaline concentration since the speed of alkaline reduction is slower than that of ordinary polyester fibers.

In the case the redaction rate is less than 0.6%, the effect of forming a carboxylic acid terminated linear oligomer component by alkaline treatment is small, and the durability of water absorbency is inferior. If the reduction rate exceeds 9%, since alkaline reduction proceeds excessively, the durability of water absorbency is also inferior. This is presumed to be because once the carboxylic acid terminated linear oligomer has been formed on the surface of the fibers, it ends up being lost due to excessive reduction. In addition, a large number of large, deep pits form on the fiber surfaces resulting in a decrease in fiber strength and thereby making this undesirable. In order to make the reduction rate to be within the range of 0.6% to 9%, for example, an alkaline treatment method consisting of treating for 5 minutes to 100 minutes at 90° C. to 100° C. with sodium hydroxide at a concentration of 1 g/L to 20 g/L is used preferably, and treating for 5 minutes to 60 minutes at 90° C. to 95° C. with sodium hydroxide at a concentration of 5 g/L to 15 g/L is even more preferable. The product of alkaline treatment concentration (g/L) and time (min) is preferably made to be within the range of 100 (g/L·min) to 800 (g/L·min), and even more preferably within the range of 200 (g/L·min) to 600 (g/L·min).

In addition, the rate of the temperature rise during alkaline treatment is also important, and the temperature is preferably raised slowly at the rate of 1° C./min to 2° C./min. Oligomer formation is presumed to be promoted by raising the temperature slowly.

Although neutralization with acid and rinsing are normally performed following alkaline treatment, in the present invention, it is extremely important to perform a specific oligomer removal treatment. Cyclic oligomers that impair water absorbency can be removed by this specific oligomer removal treatment. There are several examples of methods used to remove oligomers. Examples thereof include a method consisting of the use of an oligomer removal agent and method consisting of intensifying rinsing. Among these, a method that intensifies rinsing after alkaline treatment makes it possible to remove cyclic oligomers that impair water absorbency while making it difficult to remove n=4 to 10 carboxylic acid terminated linear oligomers that contribute to water absorbency, thereby making this particularly preferable. Rinsing conditions preferably consist of, for example, rinsing two or more times for 10 minutes to 30 minutes. Rinsing two or more times refers to performing a procedure consisting of draining the water and replacing the water two or more times. Using hot water at 40° C. to 60° C. at least once is even more preferable. Furthermore, a volatile acid such as acetic acid is preferably used for the acid used during neutralisation. Depending on the equipment used, the alkaline solution may be recovered followed by neutralization and intensified rinsing.

In the case of a fabric that is interknitted or interwoven with an another material, it is necessary to confirm the reduction rate in advance for each type of fiber and calculate the reduction rate of the polyester fibers from the mixing ratio.

A method consisting of performing alkaline treatment on polyester fibers containing 0.005% by weight to 1% by weight of S element using a cheese dyeing machine so that the reduction rate is 0.6% to 9% in the yarn state, followed by using a portion of the polyester fibers to form a fabric, is preferably applied as another method for performing alkaline treatment. In this case as well, the reduction rate is preferably 0.6% to 9%, more preferably 1% to 8%, and even more preferably 1.5% to 7%. In addition, it is preferable to rinse well as previously described.

In the present embodiment, the containing of a specific oligomer component in the polyester fibers allows the obtaining of durable water absorbency even in the case of not performing water absorption treatment. Durable water absorbency refers to making it difficult for a decrease in water absorbency to occur even after repeated laundering. In the case of imparting the oligomer by alkaline treatment, the resulting fabric after alkaline treatment, neutralization and rinsing can be dyed and finished using ordinary methods. In addition, alkaline treatment can also be performed when soaping after dyeing.

The fabric of the present embodiment has absorbency (as determined according to the dripping method of JIS L1907) of 5 seconds or less after washing 30 times according to Method C of JIS L0217 No. 103. Absorbency after washing 30 times is preferably 3 seconds or less, more preferably 2 seconds or less and even more preferably 1 second or less. Absorbency after washing once according to the same method is also preferably 5 seconds or less, more preferably 3 seconds or less, ever; more preferably 2 seconds or less and particularly preferably 1 second or less. The fabric of the present embodiment is able to retain absorbency after washing 50 times and even after washing 100 times according to the method described above, and absorbency after washing 50 times or 100 times is more preferably 5 seconds or less. A detergent such as a neutral detergent or weakly alkaline detergent is preferably used for detergent used during laundering.

In addition, the fabric of the present embodiment has a superior effect of sustaining its water absorption effect during industrial laundering. Industrial laundering is applied when laundering work clothes, uniforms and the like. This laundering is performed under more severe conditions than home laundering, and an example of a method thereof is defined in the medium temperature washer method of JIS L1096 8.39.5b) 2.2.2)F-2, and normally assistants such as hydrogen peroxide or sodium silicate are added in addition to detergent components. The fabric of the present embodiment preferably has absorbency of 5 seconds or less after washing 30 times for 30 minutes at 60° C. in accordance with JIS 1096 F-2.

In the fabric of the present embodiment, in the case of imparting a specific oligomer by a specific alkaline treatment, preferably 0.1 to 30 pits, and more preferably 0.2 to 2 pits, having a length of 0.5 μm to 5 μm are preferably formed over an area of (or per) 100 $\mu m^2$ on the surface of polyester fibers containing 0.005% by weight to 1% by weight of the S element. Pits refer to slight indentations present on the surface of a fiber, and are formed by alkaline treatment. Although numerous pits are formed and connect with each other to form striated grooves more than 5 μm in length in the case of ordinary alkaline treatment, in the present embodiment, there are preferably few striated grooves exceeding 5 μm in length. Here, the number of pits over an area of 100 $\mu m^2$ on the surface of the polyester fibers is the average value obtained by measuring the number of pits at 50 arbitrary locations on the surface of the fibers measuring 10 μm×10 μm using an electron microscope and magnifying to about 1000×. Similarly, the average number of grooves when measuring striated grooves in excess of 5 μm in length on the same surfaces is preferably 1 or less and more preferably 0.1 or less. Here, length refers to the maximum length of a single pit. The formation of extremely small pits on the surface of the polyester fibers of the present embodiment is presumed to contribute to durable water absorbency.

Pits having a length of 0.5 μm or less result in a diminished water absorption effect, and the presence of striated grooves in excess of 5 μm in length means that alkaline treatment has proceeded excessively resulting in excessive decomposition, thereby making this undesirable. In addition, in the case of more than 30 pits having a length of 0.5 μm to 5 μm, this means that alkaline treatment has proceeded excessively, thereby also making this undesirable. In the present embodiment, the rate of decrease in strength is small since there is no formation of striated grooves or through holes in excess of 5 μm in length even if subjected to alkaline reduction. Moreover, the shape of the pits in terms of the ratio of height to width is preferably 1.0 to 2.5 and more preferably 1.0 to 2.0. Here, height refers to the maximum length, while width refers to the maximum length in the direction perpendicular to the direction of height. Furthermore, pits are measured after first thoroughly cleaning the sample to prevent measurement errors caused by soiling of the sample. The sample is preferably washed once or more according to the JIS method and then rinsed for 20 minutes or more.

The fabric of the present embodiment preferably contains polyester fibers adhered with a specific oligomer over 25% or more, and preferably 40% or more, of the surface of at least one side of the fabric. Here, 25% or more refers to the percentage of the total area. In the case of using the fabric of the present embodiment as a finished product, a preferable dry feel is imparted by using the side of the polyester fibers containing the S element at 0.005% by weight to 1% by weight as previously described on the side contacting the skin.

In the case of circular knit fabric, a yarn containing polyester fibers adhered with a specific oligomer is preferably connected in the course-wise direction at the rate of at least 1 course every 8 courses. In the case polyester fibers containing 0.005% by weight to 1% by weight of the S element are not connected in the course-wise direction, the polyester fibers containing 0.005% by weight to 1% by weight of the S element are preferably connected at the rate of at least 1 wale every 4 wales. "Connecting" refers to linking by knit or tuck.

In the case of warp knit fabric, loops of polyester fibers adhered with a specific oligomer are arranged so as to be connected.

When composing the fabric of the present embodiment, it is possible to mix polyester fibers adhered with a specific oligomer with synthetic fibers such as polyester fibers, polyamide fibers or polyure thane fibers, or cellulose fibers such as cotton, rayon, cupra or acetate fibers, not adhered, with a specific oligomer.

In particular, the arrangement and migration of water retention in the fabric can be controlled as desired by combining with a water-repellent yarn subjected to water repellent processing and the like, such as by applying a fluorine-based treatment agent. For example, by arranging a water-repellent yarn and a small amount of polyester fibers adhered with the specific oligomer on the side in contact with the skin, and connecting the polyester fibers to the side on the surface, water is able to be absorbed from the polyester fibers and migrate to the surface, thereby making it possible to design a fabric that prevents perspiration from remaining on the side in contact with the skin resulting in superior perspiration absorbency.

The total fineness of the fibers used in the present embodiment is preferably 8 dtex to 167 dtex and more preferably 22 dtex to 110 dtex. Although there are no particular limitations thereon, single fiber fineness is preferably as small as possible from the viewpoint of facilitating the formation of oligomer, and is preferably 0.5 dtex to 2.5 dtex and particularly preferably 0.5 dtex to 1.5 dtex. Single fiber fineness is also preferably as small as possible from the viewpoint of feel and texture.

The fibers used in she present embodiment may contain a matting agent such as titanium dioxide, stabilizer such as phosphoric acid, ultraviolet absorber such as a hydroxybenzophenone derivative, crystal nucleating agent, such as talc, lubricant such as fumed silica, antioxidant such as a hindered phenol derivative, flame retardant, antistatic agent, pigment, fluorescent brightening agent, infrared absorbent or antifoaming agent and the like.

Crimped fibers such as false twisted yarn can also be used in the fabric of the present embodiment, and the fibers preferably have a crimp elongation rate of 0% to 150%. Furthermore, the crimp elongation rate of false twisted yarn is measured under the conditions indicated below.

After immobilizing the upper end of the false twisted yarn, a load of $1.77\times10^{-3}$ cN/dtex is applied to the lower end and length (A) is measured 30 seconds later. Next, the $1.77\times10^{-3}$ cN/dtex load is removed and load of 0.088 cN/dtex is applied followed by measuring length (B) 30 seconds later and determining the crimp elongation rate according to equation (3) indicated below.

$$\text{Crimp elongation rate (\%)}=\{(B-A)/A\}\times100 \quad (3)$$

The fabric of the present embodiment may be a woven fabric or knit fabric.

A plain weave stitch, sateen weave stitch or various derivative weave stitches derived therefrom can be applied for the weave stitch of a woven fabric. A double weave stitch in which polyester fibers adhered with 25% or more of the specific oligomer is preferably arranged on the side that contacts the skin in order to impart durable water absorbency to the side that contacts the skin.

A knit fabric may employ a circular knit or warp knit, and a weft knitting machine, double circular knitting machine, tricot knitting machine or Russell knitting machine and the like can be used for the knitting machine. The knitting gauge of the knitting machine used is preferably 10 GG to 60 GG. There are also no particular limitations on the knit stitches. A stitch in which different yarns are arranged on the top and bottom surfaces, and in which polyester fibers adhered with 25% or more of the specific polymer are arranged on the side that contacts the skin, is preferable in order to impart durable water absorbency to the side that contacts the skin.

Although there are no particular limitations thereon, the fabric weight of the present embodiment is preferably 30 g/m$^2$ to 300 g/m$^2$ and more preferably 50 g/m$^2$ to 250 g/m$^2$.

In addition, the fabric of the present invention may also be subjected to water absorption treatment.

Although the fabric of the present embodiment is preferable for clothing applications requiring a perspiration absorbent function, such as textile products including clothing and particularly sportswear and inner wear, it is not limited thereto, but rather can also be applied to other articles of clothing such as outerwear or linings, bedding such as sheets or sanitary products such as adult diapers, and demonstrates a preferable water absorption effect.

EXAMPLES

The following provides a detailed explanation of the present invention by listing examples thereof. The present invention is naturally not limited thereto.

Furthermore, the knit fabric obtained in the examples was evaluated according to the methods indicated below.

(1) Quantification of n=4 carboxylic acid terminated linear oligomer (THF-soluble component)

The previously described method was used.

(2) Quantification of n=8 carboxylic acid terminated linear oligomer component (THF-insoluble component)

The previously described method was used.

(3) Quantification of n=3 cyclic oligomer (THF-soluble component)

The previously described method was used.

(4) Quantification of Pits in Fiber Surface

The sample was washed once in accordance with Method C of JIS L0217 No. 103 (in attached Table 1) and rinsed for 20 minutes followed by acquiring an image of the surface magnified 2000× using an electron microscope, measuring the pits according to the previously described method and taking the average value of 50 locations.

(5) Wear Test

A T-shirt was produced that was fabricated such that the side having a large number of polyester fibers containing 0.005% by weight to 1% by weight of the S element on the surface thereof was on the side that contacts the skin, and the T-shirt was washed in accordance with Method C of JIS L0217 No. 103 (in attached Table 1) 30 times using "Attack" manufactured by Kao Corp. for the detergent. After washing 30 times, the T-shirt was worn, the wearer remained still for 10 minutes in an artificial climate chamber at 30° C. and 50% RH, ran for 20 minutes at a speed of 7 km/hr on the ORK-3000 treadmill manufactured by Ohtake-Root Kogyo Co., Ltd and then again remained still for 10 minutes. Feel and comfort before running and stickiness after running were respectively subjected to sensory evaluations in accordance with the evaluation criteria indicated below.

○: Good feel and texture, comfortable, no sticky sensation

Δ: Somewhat poor feel and texture, generally comfortable, some sticky sensation

X: Poor feel and texture, uncomfortable, sticky sensation (6) Water Absorbency

Water absorbency was evaluated according to the dripping method of JIS L1907.

(7) Washing Treatment

The sample was washed in accordance with Method C of JIS L0217 No. 103 (in attached Table 1) using a weak alkaline detergent ("Attack" manufactured by Kao Corp.).

(8) Industrial Laundering Test

A detergent consisting of soap at 0.8% owf, hydrogen peroxide at 0.8% owf and sodium silicate at 0.8% owf was used under conditions of the medium temperature washer method of JIS L1096 8.39.5b) 2.2.2)F-2 to simulate an industrial laundering test.

Example 1

Figure 7:
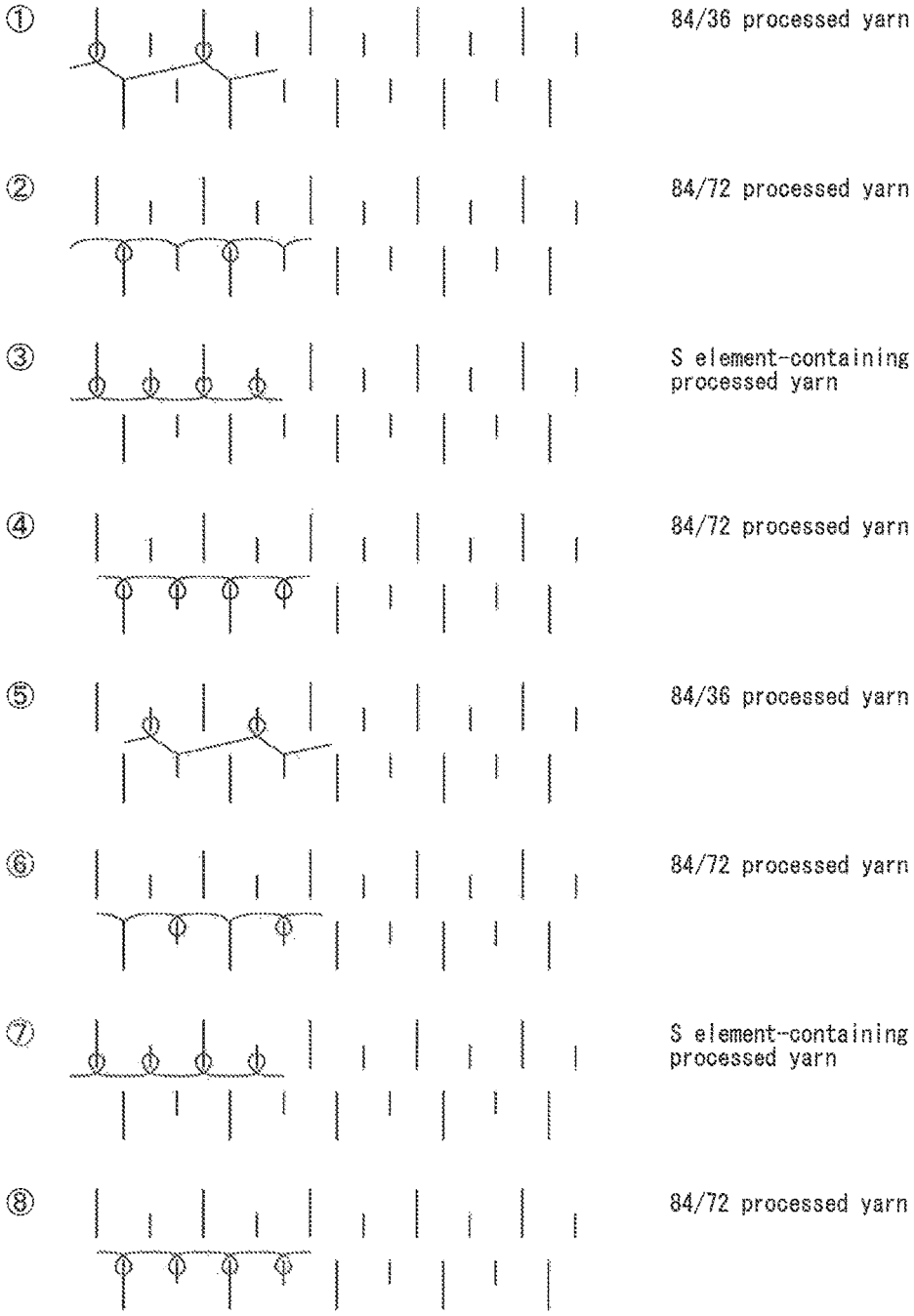
FIG. 7 shows the knit stitch of a knit fabric of Example 1.

Polyester chips containing 4.5 mol % of dimethyl sodium 5-sulfoisophthalate and polyester chips containing 99 mol % of an ordinary ethylene terephthalate component were blended so as to obtain chips adjusted to an S element of 0.3% by weight followed by spinning 84 dtex/36 f yarn and performing false twist processing to obtain a textured yarn having a circular cross-section. This textured yarn was supplied so as to indicate the knit stitch shown in FIG. 7 (encircled numbers in the drawing indicate the knitting order) using a regular yarn not containing the S element in the form of 84 dtex/36 f polyester textured yarn having a circular cross-section, 84 dtex/72 f polyester textured yarn having a circular cross-section, and a 28-gauge double circular knitting machine to obtain a gray fabric. This gray fabric was refined for 20 minutes at 80° C. using a jet dyeing machine and then rinsed followed by presetting for 90 seconds at 180° C. and tentering ratio of 20% with a pin tenter. Subsequently, the temperature was raised at 2° C./min with a jet dyeing machine tinder conditions of a sodium hydroxide concentration of 9 g/L, followed by performing alkaline treatment for 45 minutes at 95° C., neutralizing with acetic acid and rinsing well. Rinsing conditions consisted of heating to 60° C. after pouring in water followed by washing for 15 minutes. Subsequently, the water was temporarily drained and the temperature was again raised to 60° C. after pouring in water followed by rinsing for 15 minutes and draining (Rinsing Conditions A). The reduction rate of the 84 dtex/36 f textured yarn containing the S element was 4.8%. Subsequently, the polyester yarn was dyed and rinsed, at 130° C., stretched with a pin tenter to a degree that removed wrinkles and then final set for 90 seconds at 150° C. to obtain a knit fabric having a fabrics weight of 130 g/m$^2$ and thickness of 0.62 mm. Water absorbency of this knit fabric after washing 30 times according to Method C of JIS L0217 No. 103 (in attached Table 1) and the medium temperature washer method of JIS L1096 8.39.5b) 2.2.2)F-2 was less than 1 second and 2 seconds, respectively, and in a wear test of a shirt made with this knit fabric (in which textured fibers containing the S element were arranged on the side that contacts the skin), results were obtained indicating that the shirt was soft, comfortable and did not produce a sticky sensation even after perspiring. In addition, water absorbency was less than 1 second even after washing 100 times according to Method C of JIS L0217 No. 103 (in attached Table 1).

Example 2

A knit fabric having a half tricot stitch was formed using a 28 GG tricot knitting machine, using 56 dtex/24 f polyester yarn (3 element content: 0.17% by weight) having a circular cross-section and containing 2.5 mol % of dimethyl sodium 5-sulfoisophthalate for the front, and using 44 dtex polyurethane yarn for the back. After relaxing and refining at 80° C., the fabric was heat-set at 190° C., heated with a jet dyeing machine at 2° C./min under conditions of a sodium hydroxide concentration of 10 g/L, subjected to alkaline treatment for 45 minutes at 95° C., and neutralized, with acetic acid and rinsed well. Rinsing conditions consisted of repeating rinsing for 15 minutes at 60° C. twice (Rinsing Conditions A). The reduction rate was 6.5%. Moreover, dyeing at 130° C. and final setting at 170° C. were performed to obtain a knit fabric having a fabric weight of 180 g/m$^2$ and thickness of 0.58 mm. Water absorbency of this knit fabric after washing 30 times according to Method C of JIS L0217 No. 103 (in attached Table 1) and the medium temperature washer method of JIS L1096 8.39.5b) 2.2.2)F-2 was less than 1 second and 2 seconds, respectively, and in a wear test of a shirt made with this knit fabric, results were obtained indicating that the shirt was soft, comfortable and did not produce a sticky sensation even after perspiring.

Example 3

Figure 8:
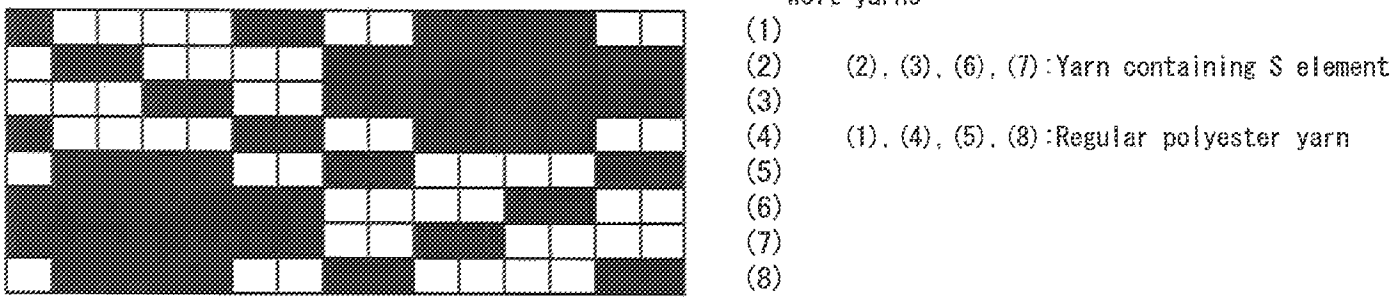
FIG. 8 shows an organizational chart of a double woven fabric of Example 3.

The double woven fabric of FIG. 8 was fabricated using 56 dtex/72 f polyester textured yarn not containing the S element for the warp, and distributing a 167 dtex/72 f polyester textured yarn (S element content: 0.17% by weight) containing 2.5 mol % of dimethyl sodium 5-sulfoisophthalate and having a circular cross-section together with a 84 dtex/72 f two-fold polyester textured yarn not having the S element for the weft. After refining at 80° C. the fabric was heat-set at 190° C., heated with a jet dyeing machine under conditions of a sodium hydroxide concentration of 7 g/L and 2° C./min, subjected to alkaline treatment for 60 minutes at 95° C., neutralized with acetic acid, and rinsed well. Rinsing conditions consisted of repeating rinsing for 15 minutes at 60° C. twice (Rinsing Conditions A). The reduction rate was 3.9%. Moreover, dyeing at 130° C. and final setting at 170° C. were performed to obtain a woven fabric having a fabric weight of 155 g/m$^2$ and thickness of 0.40 mm. Water absorbency of this knit fabric after washing 30 times according to Method C of JIS L0217

No. 103 (in attached Table 1) and the medium temperature washer method of JIS L1096 8.39.5b) 2.2.2)F-2 was 1 second and 5 seconds, respectively, and in a wear test of clothing wear obtained from this woven fabric, results were obtained indicating that the clothing wear was soft, comfortable and did not produce a sticky sensation even after perspiring.

Example 4

A knit fabric having a fabric weight of 138 g/m$^2$ and thickness of 0.63 mm was obtained in the same manner as Example 1 with the exception of changing the concentration during alkaline treatment to 5 g/L and changing the treatment time to 20 minutes. Water absorbency of this knit fabric after washing 30 times according to Method C of JIS L0217 No. 103 (in attached Table 1) and the medium temperature washer method of JIS L1096 8.39.5b) 2.2.2)F-2 was 2 seconds and 5 seconds, respectively, and in a wear test of a shirt using this knit fabric, results were obtained indicating that the shirt was soft, comfortable and did not produce a sticky sensation even after perspiring. In addition, water absorbency was 2 seconds even after washing 100 times according to Method C of JIS L0217 No. 103 (in attached Table 1).

Example 5

A knit fabric having a fabric weight of 175 g/m$^2$ and thickness of 0.59 mm was obtained in the same manner as Example 2 with the exception of using 56 dtex/24 f polyester yarn (S element content: 0.18% by weight) containing 2.5 mol % of sodium 4-sulfo-2,6-naphthalenedicarboxylate and having a circular cross-section instead of 56 dtex/24 g polyester yarn containing 2.5 mol % of dimethyl sodium 5-sulfoisophthalate and having a circular cross-section. Water absorbency of this knit fabric after washing 30 times according to Method C JIS L0217 No. 103 (in attached Table 1) and the medium temperature washer method of JIS L1096 8.39.5b) 2.2.2)F-2 was 1 second and 6 seconds, respectively, and in a wear test of a shirt using this knit fabric, results were obtained indicating that the shirt was soft, comfortable and did not produce a sticky sensation even after perspiring.

Example 6

84 dtex/36 f polyester textured yarn containing 2.5 mol % of dimethyl sodium 5-sulfoisophthalate and having a circular cross-section was heated using a cheese dyeing machine under conditions of a sodium hydroxide concentration of 10 g/L and 2° C./min followed by performing alkaline treatment for 45 minutes at 95° C., neutralizing using acetic acid and rinsing well. Rinsing conditions consisted of repeating rinsing for 15 minutes at 60° C. twice (Rinsing Conditions A). The reduction rate of the textured yarn was 5.1%. A gray fabric was then obtained by using this S element-containing textured yarn (S element content: 0.17% by weight), 84 dtex/36 f polyester textured yarn not containing the S element and having a circular cross-section, and 84 dtex/72 f polyester textured yarn not containing the S element and having a circular cross-section, and forming into the knit stitch shown in FIG. 3 using a 28-gauge double circular knitting machine. After refining this gray fabric for 20 minutes at 80° C. using a jet dyeing machine and rinsing, presetting was performed for 90 seconds at 180° C. and tentering ratio of 20% with a pin tenter. Subsequently, the gray fabric was subjected to polyester dyeing at 130° C. and rinsing, stretched with a pin tenter to a degree that removed wrinkles and then final set for 90 seconds at 150° C. to obtain a knit fabric having a fabric weight of 135 g/m$^2$ and thickness of 0.63 mm. Water absorbency of this knit fabric after washing 30 times according to Method C of JIS L0217 No. 103 (in attached Table 1) and the medium temperature washer method of JIS L1096 8.39.5b) 2.2.2)F-2 was 1 second and 2 seconds, respectively, and in a wear test of a shirt using this knit fabric, results were obtained indicating that the shirt was soft, comfortable and aid not produce a sticky sensation even after perspiring. In addition, water absorbency was also 1 second even after washing 100 times according to Method C of JIS L0217 No. 103 (in attached Table 1).

Example 7

A knit fabric having a fabric weight of 134 g/m$^2$ and thickness of 0.63 mm was obtained in the same manner as Example 1 with the exception of changing the rinsing conditions following alkaline treatment to rinsing once at 20° C. for 15 minutes (Rinsing Conditions B). Water absorbency of this knit fabric after washing 30 times according to Method C of JIS L0217 No. 103 (in attached Table 1) and the medium temperature washer method of JIS L1096 8.39.5b) 2.2.2)F-2 was 5 seconds and 180 seconds or more, demonstrating superior water absorbency following repeated washing under the former conditions. In a wear test of a shirt using this knit fabric, results were obtained indicating that, although it was generally comfortable in comparison with a fabric not having water absorbency, there was somewhat of a sticky sensation when perspiring. In addition, water absorbency was 10 seconds after washing 100 times according to Method C of JIS L0217 No. 103 (in attached Table 1).

Comparative Example 1

A knit fabric having a fabric weight of 135 g/m$^2$ and thickness of 0.65 mm was obtained in the same manner as Example 1 with the exception of using 84 dtex/36 f regular polyester textured yarn (not containing the S element) having a circular cross-section instead of the textured yarn obtained by blending the polyester chips containing 4.5 mol % of dimethyl sodium 5-sulfoisophthalate and polyester chips containing 85 mol % of an ordinary ethylene terephthalate component. Water absorbency of this knit fabric after washing 30 times according to Method C of JIS L0217 No. 103 (in attached Table 1) and the medium temperature washer method of JIS L1096 8.39.5b) 2.2.2)F-2 was 180 seconds or more and 180 seconds or more, respectively, and in a wear test of a shirt using this knit fabric, results were obtained indicating that the shirt produced a sticky sensation when perspiring.

Comparative Example 2

A knit fabric having a fabric weight of 136 g/m$^2$ and thickness of 0.65 mm was obtained in the same manner as Example 1 with the exception of using 84 dtex/36 f regular polyester textured yarn (not containing the S element) having a circular cross-section instead of the textured yarn obtained by blending the polyester chips containing 4.5 mol % of dimethyl sodium 5-sulfoisophthalate and the polyester chips containing 95 mol % of an ordinary ethylene terephthalate component, and adding 2% owf of SP1000 manufactured by Takamatsu Oil & Fat Co., Ltd. without performing alkaline treatment. Water absorbency of this knit fabric after washing 30 times according to Method C of JIS L0217 No. 103 (in attached Table 1) and the medium temperature washer method of JIS L1096 8.39.5b) 2.2.2)F-2 was 15 seconds or more and 180 seconds or more, respectively, and in a wear test of a shirt using this knit fabric, results were obtained indicating that the shirt produced a sticky sensation when perspiring.

Comparative Example 3

A knit fabric having a fabric weight of 133 g/m$^2$ and thickness of 0.64 mm was obtained in the same manner as Example 1 with the exception of changing the sodium hydroxide concentration during alkaline treatment to 0.5 g/L. Water absorbency of this knit fabric after washing 30 times according to Method C of JIS L0217 No. 103 (in attached Table 1) and the medium temperature washer method of JIS L1096 8.39.5b) 2.2.2)F-2 was 180 seconds or more and 180 seconds or more, respectively, and in a wear test of a shirt using this knit fabric, results were obtained indicating that the shirt produced a sticky sensation when perspiring.

Comparative Example 4

A knit fabric having a fabric weight of 118 g/m$^2$ and thickness of 0.53 mm was obtained in the same manner as Example 1 with the exception of changing the sodium hydroxide concentration during alkaline treatment to 24 g/L. Water absorbency of this knit fabric after washing 30 times according to Method C of JIS L0217 No. 103 (in attached Table 1) and the medium temperature washer method of JIS L1096 8.39.5b) 2.2.2)F-2 was 180 seconds or more and 180 seconds or more, respectively, and in a wear test of a shirt using this knit fabric, results were obtained indicating that the shirt produced a sticky-sensation when perspiring.

Comparative Example 5

A knit fabric having a fabric weight of 124 g/m$^2$ and thickness of 0.53 mm was obtained in the same manner as Comparative Example 1 with the exception of changing the sodium hydroxide concentration during alkaline treatment to 50 g/L. The reduction rate of this knit fabric was 13%. Water absorbency of this knit fabric after washing 30 times according to Method C of JIS L0217 No. 103 (in attached Table 1) and the medium temperature washer method of JIS L1096 8.39.5b) 2.2.2)F-2 was 180 seconds or more and 180 seconds or more, respectively, and in a wear test of a shirt using this knit fabric, results were obtained indicating that the shirt produced a sticky sensation when perspiring.

Results for the aforementioned examples and comparative examples are summarized in the following Table 2.

Figure 2:
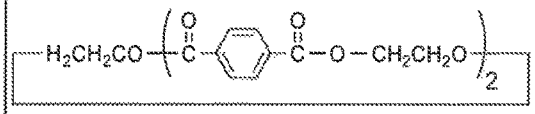
FIG. 2 is a table showing presumed structures associated with the characteristic peaks observed in the UV chromatogram of FIG. 1.
Figure 2:
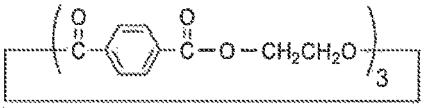
Figure 2:
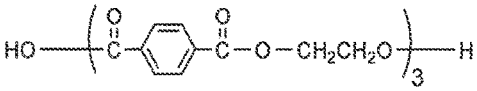
Figure 2:
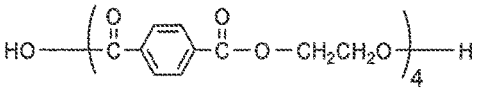

| | Yarn<br>Es: Polyester<br>Pu: Polyurethane | Structure | Alkaline concen-tration g/L | Rinsing condi-tions | Reduction rate of S-containing yarn % | Water absorption treatment | Fabric weight g/m$^2$ | Thick-ness mm | Water absorb-ency after 1 time washing | Water absorb-ency after 30 time washings | Water absorbency after 30 time industrial launderings | Concentra-tion of n = 4 carboxylic acid termi-nated linear oligomer by internal stan-dardization | Peak intensity ratio of n = 8 carboxylic acid termi-nated linear oligomer to internal standard | Concentra-tion of n = 3 cyclic oligomer by by internal standard-ization | No. of pits | Pit height/ width | Feel when worn | Comfort when worn | Sticki-ness when per-spiring |
|---|---|---|---|---|---|---|---|---|---|---|---|---|---|---|---|---|---|---|---|
| Ex. 1 | 84dtex/36f S-containing Es yarn, 84 dtex/36f S-free Es yarn 84 dtex/72f S-free Es yarn | Circular knit, FIG. 1 | 9 | A | 4.8 | None | 130 | 0.62 | Less than 1 | Less than 1 | 2 | 4.5 | 0.013 | 53 | 1.0 | 1.8 | ○ | ○ | ○ |
| Ex. 2 | 56dtex/24f S-containing Es yarn, 445tex Pu yarn | Half tricot | 10 | A | 6.5 | None | 180 | 0.58 | Less than 1 | Less than 1 | 2 | 4.8 | 0.015 | 58 | 1.4 | 2.0 | ○ | ○ | ○ |
| Ex. 3 | 167dtex/72f S-containing Es yarn, 84 dtex/72f S-free Es yarn 56dtex/72f S-free Es yarn | Double weave, FIG. 2 | 7 | A | 3.9 | None | 155 | 0.42 | Less than 1 | 1 | 5 | 4.2 | 0.023 | 51 | 0.6 | 1.6 | ○ | ○ | ○ |
| Ex. 4 | 84dtex/36f S-containing Es yarn, 84 dtex/36f S-free Es yarn 84dtex/72f S-free Es yarn | Circular knit, FIG. 1 | 5 | A | 0.7 | None | 138 | 0.63 | Less than 1 | 2 | 5 | 3.1 | 0.008 | 67 | 0.4 | 1.8 | ○ | ○ | ○ |
| Ex. 5 | 56dtex/24f S-containing Es yarn, 44dtex Pu yarn | Half tricot | 10 | A | 5.6 | None | 175 | 0.59 | Less than 1 | 1 | 6 | 4.8 | 0.015 | 57 | 0.3 | 1.5 | ○ | ○ | ○ |
| Ex. 6 | 84dtex/36f S-containing Es yarn (alkaline treatment), 84 dtex/36f S-free Es yarn 84dtex/72f S-free Es yarn | Circular knit, FIG. 1 | 10 | A | 5.1 | None | 135 | 0.63 | Less than 1 | 1 | 2 | 5.9 | 0.023 | 52 | 1.3 | 2.2 | ○ | ○ | ○ |

-continued

| | Yarn<br>Es: Polyester<br>Pu: Polyurethane | Structure | Alkaline concentration g/L | Rinsing conditions | Reduction rate of S-containing yarn % | Water absorption treatment | Fabric weight g/m$^2$ | Thickness mm | Water absorbency after 1 time washing | Water absorbency after 30 time washings | Water absorbency after 30 time industrial launderings | Concentration of n = 4 carboxylic acid terminated linear oligomer by internal standardization | Peak intensity ratio of n = 8 carboxylic acid terminated linear oligomer to internal standard | Concentration of n = 3 cyclic oligomer by by internal standardization | No. of pits | Pit height/width | Feel when worn | Comfort when worn | Stickiness when perspiring |
|---|---|---|---|---|---|---|---|---|---|---|---|---|---|---|---|---|---|---|---|
| Ex. 7 | 84dtex/36f S-containing Es yarn, 84 dtex/36f S-free Es yarn 84dtex/72f S-free Es yarn | Circular knit, FIG. 1 | 9 | B | 4.7 | None | 134 | 0.63 | 10 | 5 | 35 | 2.5 | 0.011 | 135 | 0.08 | 1.5 | ○ | Δ | Δ |
| Comp. Ex. 1 | 84 dtex/36f S-free Es yarn 84dtex/72f S-free Es yarn | Circular knit, FIG. 1 | 9 | A | — | None | 135 | 0.65 | 15 | 180 or more | 180 or more | 0 | 0 | 83 | 0.02 | 1.5 | Δ | × | × |
| Comp. Ex. 2 | 84 dtex/36f S-free Es yarn 84dtex/72f S-free Es yarn | Circular knit, FIG. 1 | — | — | — | Performed | 136 | 0.65 | Less than 1 | 180 or more | 180 or more | 0 | 0 | 92 | 0 | 0 | Δ | Δ | × |
| Comp. Ex. 3 | 84 dtex/36f S-containing Es yarn, 84dtex/36f S-free Es yarn 84dex/72f S-free Es yarn | Circular knit, FIG. 1 | 0.5 | A | 0.5 | None | 133 | 0.64 | 1.2 | 180 or more | 180 or more | 0.8 | 0.003 | 85 | 0.08 | 1.5 | Δ | × | × |
| Comp. Ex. 4 | 84 dtex/36f S-containing Es yarn, 84dtex/36f S-free Es yarn 84dex/72f S-free Es yarn | Circular knit, FIG. 1 | 24 | A | 21 | None | 118 | 0.53 | 2 | 180 or more | 180 or more | 0 | 0 | 98 | 35 | 4.0 | ○ | × | × |
| Comp. Ex. 5 | 84 dtex/36f S-free Es yarn 84dex/72f S-free Es yarn | Circular knit, FIG. 1 | 50 | A | — | None | 124 | 0.59 | 2 | 180 or more | 180 or more | 0 | 9 | 90 | 22 | 6.0 | ○ | × | × |

* Rinsing conditions A: Heating to 60° C. after pouring in water and rinsing for 15 minutes. Pouring in water again after draining followed by heating to 60° C. and rinsing for 15 minutes.
* Rinsing conditions B: Rinsing for 15 minutes under conditions of 20° C. after pouring in water.

INDUSTRIAL APPLICABILITY

The absorbent fabric according to the present invention semi-permanently absorbs water even in the case of not being subjected to water absorption treatment, is able to quickly absorb perspiration when worn, has superior comfort, and is soft and has a pleasant feel, thereby enabling it to be preferably used in applications such as inner wear or sportswear.

The invention claimed is:

1. An absorbent fabric comprising polyester fibers wherein the polyester fibers contain 0.005% by weight to 1% by weight of the element sulfur, 95 mol % or more of the repeating units of the polyester is ethylene terephthalate, carboxylic acid terminated linear oligomer components are present on the surface of the polyester fibers, wherein the concentration of a n=4 carboxylic acid terminated linear oligomer component represented by the following Formula 1:

[Formula 1]

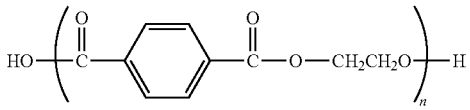

as measured in LC/MS (liquid chromatography-mass spectroscopy) is equivalent to a concentration of 3 μg/ml to 15 μg/ml converted to a concentration of methyl benzoate by internal standardization, wherein the concentration of a n=3 cyclic oligomer represented by the following Formula 2:

[Formula 2]

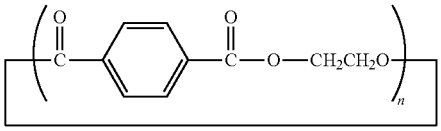

as measured in LC/MS (liquid chromatography-mass spectroscopy) is equivalent to a concentration of 70 μg/ml or less converted to a concentration of methyl benzoate by internal standardization, and wherein water absorbency according to the dripping method of JIS L1907 after washing 100 times according to Method C of JIS L0217 No. 103 is 5 seconds or less.

2. The absorbent fabric according to claim 1, wherein the polyester fibers containing 0.005% by weight to 1% by weight of the element sulfur are polyester fibers containing 0.5 mol % to 5 mol % of an ester-forming sulfonate compound.

3. The absorbent fabric according to claim 2, wherein the ester-forming sulfonate compound is a metal sulfonate group-containing isophthalic acid.

4. The absorbent fabric according to claim 1, wherein 0.1 to 30 pits having a length of 0.5 μm are formed in an area of 100 $\mu m^2$ on the surface of the polyester fibers containing 0.005% by weight to 1% by weight of the element sulfur.

5. The absorbent fabric according to claim 1, wherein the peak intensity ratio of a Na adduct of a n=8 carboxylic acid terminated liner oligomer component represented by the following Formula 1:

[Formula 1]

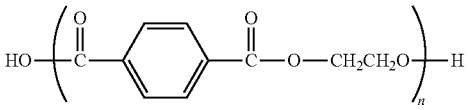

to a Na adduct of α-cyano-4-hydroxycinnamic acid (CHCA) as an internal standard, as measured in MALDI-TOF/MS, is 0.05 to 0.100.

6. A method for producing the absorbent fabric according to claim 1, comprising:

a step for performing alkaline reduction on polyester fibers at a reduction rate of 0.6% to 9% in a fabric containing polyester fibers containing the S element at 0.005% by weight to 1% by weight.

* * * * *